US006701652B1

(12) United States Patent
McElhatton et al.

(10) Patent No.: US 6,701,652 B1
(45) Date of Patent: Mar. 9, 2004

(54) MOLDED EMBLEM WITH ENCAPSULATED EMBOSSED 3-D GRAPHICS

(75) Inventors: Michael D. McElhatton, Kewaskum, WI (US); Michael G. Reindl, Kewaskum, WI (US); Michael J. Ruminski, West Bend, WI (US)

(73) Assignee: Serigraph, Inc., West Bend, WI (US)

( * ) Notice: Subject to any disclaimer, the term of this patent is extended or adjusted under 35 U.S.C. 154(b) by 78 days.

(21) Appl. No.: 10/045,476

(22) Filed: Oct. 22, 2001

(51) Int. Cl.[7] ..... G09F 19/00; G09F 3/10
(52) U.S. Cl. ..... 40/615; 40/616; 40/675
(58) Field of Search ..... 40/615, 616, 675; 428/174, 187, 201, 203

(56) References Cited

U.S. PATENT DOCUMENTS 3,246,066 A * 4/1966 Gits ..... 264/132
3,313,052 A * 4/1967 Malster ..... 283/70
4,469,725 A * 9/1984 Fischer et al. ..... 428/13
5,351,142 A * 9/1994 Cueli ..... 359/2
5,429,857 A * 7/1995 Amemiya et al. ..... 428/156
5,589,021 A * 12/1996 Bloom ..... 156/219
6,264,869 B1 * 7/2001 Notarpietro et al. ..... 264/247
2002/0142111 A1 * 10/2002 Auld et al. ..... 428/13

* cited by examiner

*Primary Examiner*—Brian K. Green
(74) *Attorney, Agent, or Firm*—Andrus, Sceales, Starke & Sawall, LLP

(57) ABSTRACT

An emblem (**20, 20*a*, 20*b*) with encapsulated embossed 3-D graphics is provided by a substrate (22) having a first side (24) and an opposite second side (26), an ink pattern (28) printed on the second side and providing embossed 3-D graphics, and a transparent layer (30) molded on the first side and through which the graphics are viewable. The substrate is softer than the ink pattern and deforms there-around during molding of the transparent layer, to provide differing depths. A mold (36, 38) has a smooth nonembossed surface (42**) engaging the second side of the substrate without a 3-D mold-insert.

17 Claims, 3 Drawing Sheets

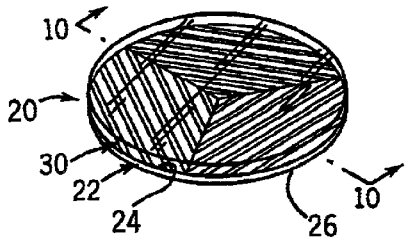
FIG. 1
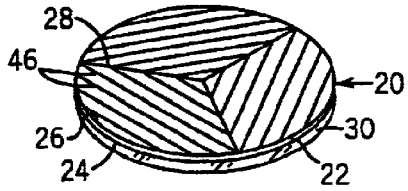
FIG. 2
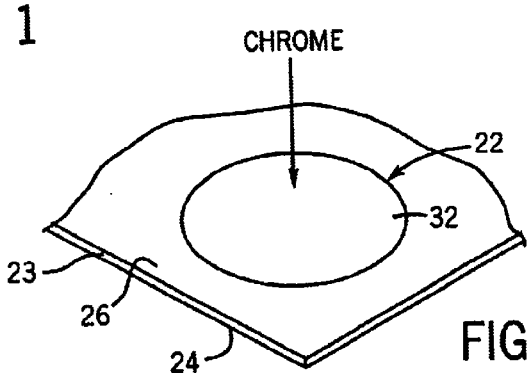
FIG. 3
FIG. 4
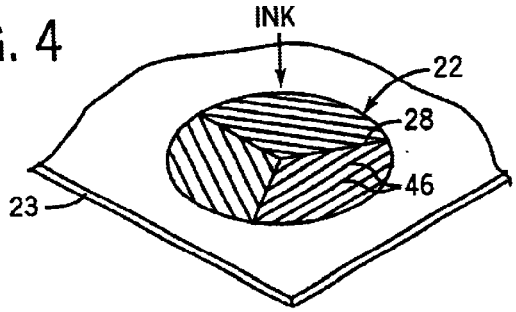
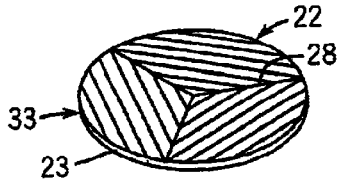
FIG. 6
FIG. 5
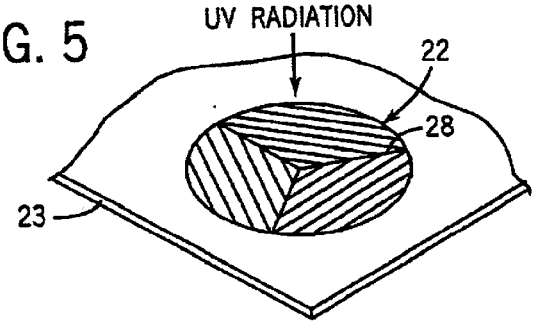

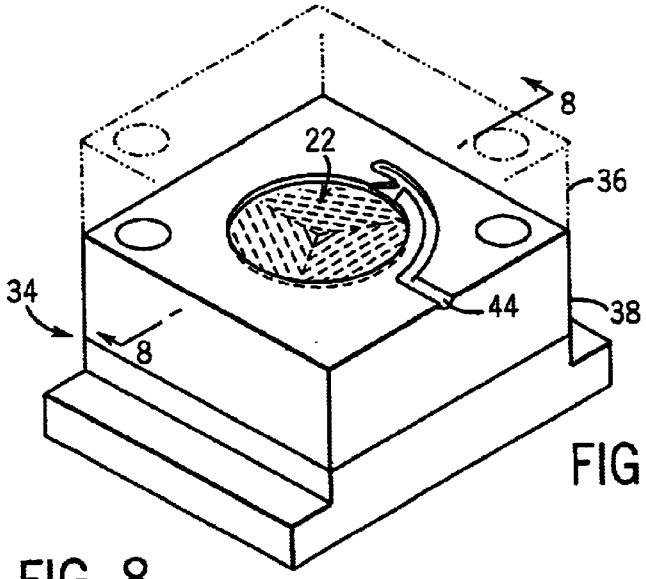
FIG. 7
FIG. 8
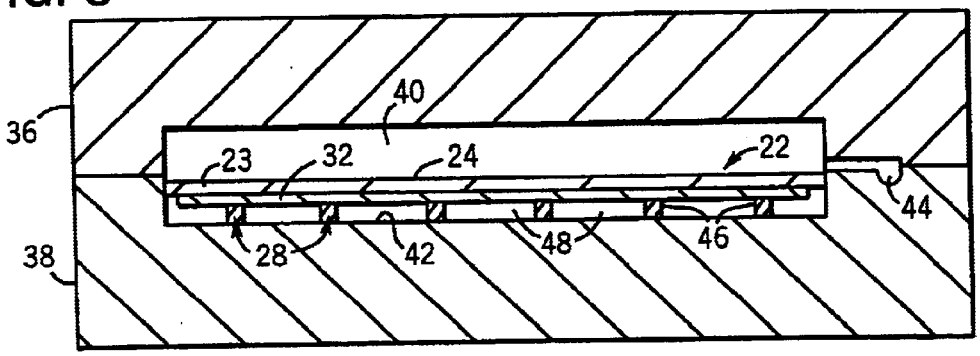
FIG. 9
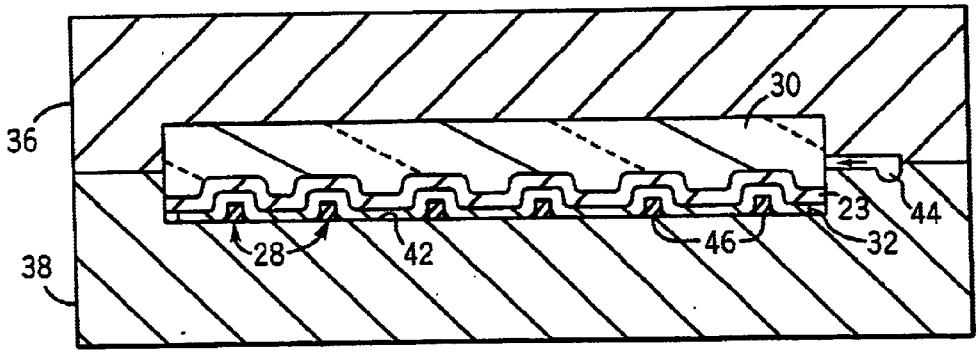
FIG. 10
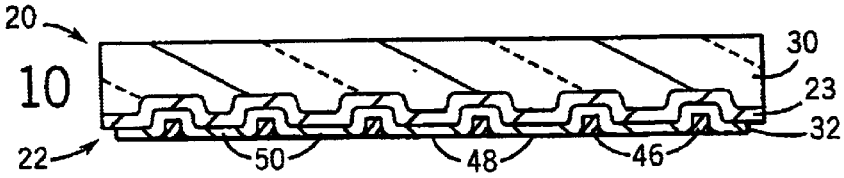

FIG. 11
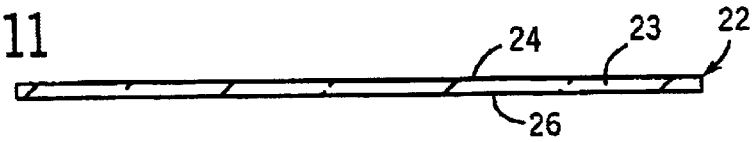
FIG. 12
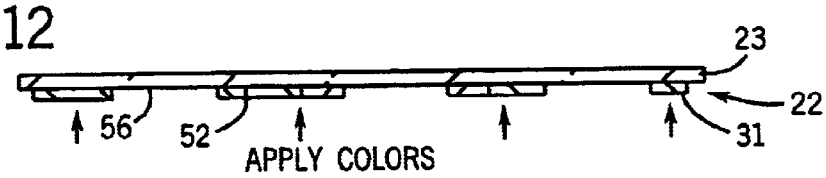
FIG. 13
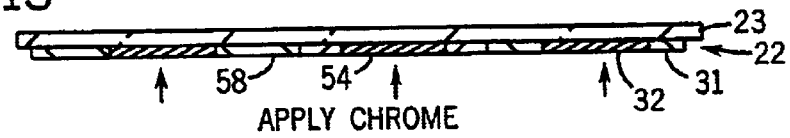
FIG. 14
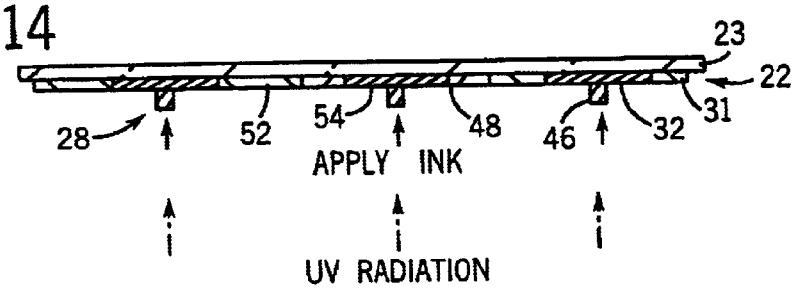
FIG. 15
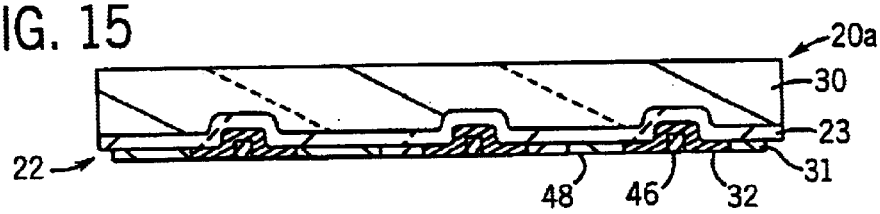
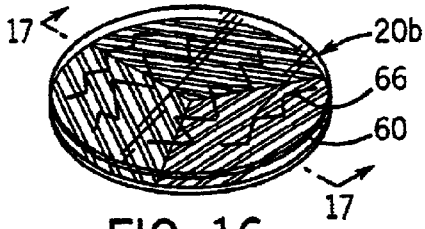
FIG. 16
FIG. 17
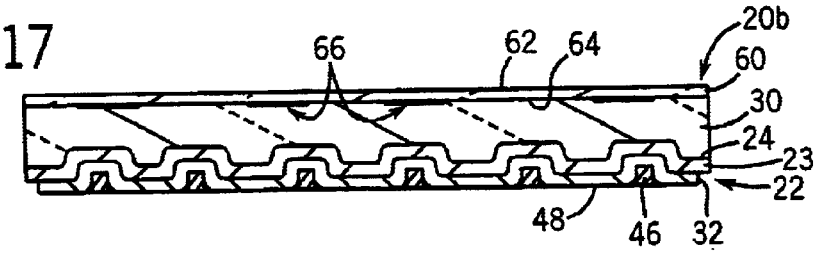

MOLDED EMBLEM WITH ENCAPSULATED EMBOSSED 3-D GRAPHICS

BACKGROUND AND SUMMARY OF THE INVENTION

The invention relates to emblems such as medallions, tags, logos, and the like, having various uses including decoration, information, and identification.

The invention arose during efforts to provide an emblem having a transparent molded layer with encapsulated embossed 3-D graphics viewable therethrough and on the backside thereof. This is accomplished in the present invention in a particularly simple and effective manner.

BRIEF DESCRIPTION OF THE DRAWINGS

FIG. 1 is a top perspective view of an emblem in accordance with the invention.

FIG. 2 is a bottom perspective view of the emblem of FIG. 1.

FIG. 3 illustrates a processing step.

FIG. 4 illustrates a further processing step.

FIG. 5 illustrates a further processing step.

FIG. 6 illustrates a further processing step.

FIG. 7 is a perspective view of a mold for forming the emblem of FIG.

FIG. 8 is a sectional view taken along line 8—8 of FIG. 7.

FIG. 9 is like FIG. 8 and shows a further processing step.

FIG. 10 is like FIG. 9 and shows a further processing step.

FIG. 11 shows a processing step in accordance with a further embodiment.

FIG. 12 shows a further processing step.

FIG. 13 shows a further processing step.

FIG. 14 shows a further processing step.

FIG. 15 shows a further processing step.

FIG. 16 is a top perspective view of the resulting emblem of FIG. 15.

FIG. 17 is a sectional view taken along line 17—17 of FIG. 16.

DETAILED DESCRIPTION

FIG. 1 shows an emblem 20 having a substrate 22 with a first or frontside 24 facing upwardly, and an opposite second or backside 26 facing downwardly. An ink pattern 28, FIG. 2, is printed on second or backside 26 to provide graphics, to be described. A transparent layer 30 is molded on first or front side 24, and the noted graphics are viewable through such transparent layer. Substrate 22, FIG. 3, is provided by a thin film transparent base layer 23 preferably of polycarbonate, acrylic or styrene, preferably having a thickness of 0.005 to 0.007 inch. An ink layer 32, which in one embodiment is provided by chrome, aluminum, or metallic ink, is printed on second surface 26 of the substrate, followed by printing of ink pattern 28 on layer 32, FIG. 4. Ink pattern 28 is preferably provided by ultraviolet, UV, radiation hardenable ink, which is then UV hardened, FIG. 5, followed by cutting and trimming of the substrate to yield disc 33, FIG. 6.

Disc 33 is then placed in a mold 34, FIG. 7, having an upper mold half 36 and a lower mold half 38 defining a cavity 40 therebetween, FIG. 8. Disc substrate 22 is placed in the lower mold half 38 with second side 26, ink layer 32 and ink pattern 28 facing mold surface 42. The mold is then closed, and hot molding resin, preferably polycarbonate, acrylic, styrene, or the like, is injected or shot through feeder channel 44 into cavity 40 over first side 24 of the substrate. Ink pattern 28 is provided by a plurality of ink areas 46, FIGS. 4, 8, separated by gap regions 48 therebetween. Ink layer 32 printed on the substrate is not UV hardenable ink. After the UV hardening of ink pattern 28, such ink pattern is harder than ink layer 32 and base layer 23. The softer ink layer 32 and base layer 23 thus deform around ink pattern 28 during molding of molded transparent layer 30, FIG. 9. Base layer 23 and ink layer 32 deform around UV hardened ink areas 46 of ink pattern 28 and into gap regions 48. After cooling and hardening of the injected resin, the mold is opened, and the part removed to yield emblem 20, FIG. 10. Ink layer 32 includes portions 50, FIG. 10, in gap regions 48. Ink layer 32 has differing depths in base layer 23, including a first depth at ink areas 46 and a second different depth at gap regions 48. Base layer 23 has differing depths in transparent layer 30, including a first depth at the noted first depth of ink layer 32 at ink areas 46, and a second depth at the noted second depth of ink layer 32 at gap regions 48. As noted, ink layer 32 and base layer 23 are softer than ink pattern 28 and deform therearound during molding of transparent layer 30, to provide the noted differing depths of ink layer 32 and base layer 23. The differing depths provide embossed 3-D graphics, which are encapsulated by molded transparent layer 30 and viewable through the latter from above, FIGS. 1, 10.

FIGS. 11–15 show an alternate embodiment, and use like reference numerals from above where appropriate to facilitate understanding. Substrate 22 is provided by a transparent base layer 23 having first and second ink layers 31 and 32, FIGS. 12, 13, printed on second side 26. Layer 31 may be one or more different colors, and layer 32 is preferably chrome, aluminum or metallic ink as above. Ink pattern 28, FIG. 14, is printed on ink layer 32 and includes the noted plurality of ink areas 46 separated by gap regions 48 therebetween. Ink layer 31 includes portions such as 52 in gap regions 48. Ink layer 32 includes portions such as 54 in gap regions 48. Ink layer 31, FIG. 12, has a plurality of ink regions 52 separated by a second set of gap regions 56 therebetween. Ink layer 32, FIG. 13, has a plurality of ink regions 54 separated by a third set of gap regions 58 therebetween. Ink regions 54 of ink layer 32 are in the noted second set of gap regions 56. Ink regions 52 of ink layer 31 are in the noted third set of gap regions 58. Ink regions 52 and 54 of each of ink layers 31 and 32 are in the first noted set of gap regions 48, FIG. 14. The substrate is then exposed to UV radiation, FIG. 14, as above, to UV harden ink pattern 28, followed by the noted cutting and trimming, and then molding as in FIGS. 7–9, to yield emblem 20*a*, FIG. 15. Ink layer 32 has differing depths in base layer 23, including a first depth at ink areas 46, and a second different depth at gap regions 48. Base layer 23 has differing depths in molded transparent layer 30, including a first depth at the noted first depth of ink layer 32 at ink areas 46, and a second depth at the noted second depth of ink layer 32 at gap regions 48. Ink layer 31 has a single depth in base layer 23, without differing depths. As above, ink layer 32 and base layer 23 are softer than ink pattern 28.

FIGS. 16 and 17 show a further embodiment, and use like reference numerals from above where appropriate to facilitate understanding. A second substrate 60, preferably a thin film layer like layer 23, is provided on the opposite side of molded transparent layer 30 from substrate 22. Substrate 60 has a first or frontside 62 facing upwardly, and a second or backside 64 facing downwardly. Second side 64 of substrate 60 faces first side 24 of substrate 22 across molded transparent layer 30. A second ink pattern 66 is printed on second side 64 of second substrate 60. Substrate 60 is placed in upper mold half 36 prior to resin injection, and the molding operation is carried out as in FIGS. 7–9, to yield emblem 20*b*. In the preferred version of this embodiment, second ink pattern 66 is not formed to a 3-D image. Ink pattern 66 is composed of high temperature resistant ink directly contacted by the injected resin during molding and hence directly contacted by molded transparent layer 30. In the embodiments of FIGS. 1–15, base layer 23 is transparent and is selected from the group consisting of clear, translucent and tinted materials. Molded layer 30 is transparent and is selected from the group consisting of clear, translucent and tinted materials. In the embodiment of FIGS. 16 and 17, second substrate 60 is also transparent and is selected from the group consisting of clear, translucent and tinted materials.

In a desirable aspect, the mold has a smooth nonembossed surface 42, FIGS. 8, 9, engaging the noted second surface or backside of substrate 22 without a 3-D or embossed mold-insert. This is desirable because it eliminates the need for such mold-inserts and enables universal application without a custom mold or a custom mold-insert for each pattern desired. Instead, a desired ink pattern 28 is merely printed on second surface 26 to yield the desired embossed 3-D graphic. The same mold may be used for different graphics by merely printing a different ink pattern 28. This universal application of mold tooling is simple and cost effective. The embossed 3-D graphic is viewable from above in FIGS. 1, 10, 15, 16, 17, through transparent substrate 60, if used, and through molded transparent layer 30. In a further embodiment, a curved mold may be used, including a curved or arcuate mold surface 42, to provide a curved emblem, which provides a lens effect magnifying the noted embossed 3-D graphic as viewed from above if the curvature is convex as viewed from above.

It is recognized that various equivalents, alternatives and modifications are possible within the scope of the appended claims which distinctly define the subject matter regarded as the invention.

What is claimed is:

1. An emblem with encapsulated embossed 3-D graphics comprising a substrate having a first side and an opposite second side, an ink pattern printed on said second side and providing the embossed 3-D graphics, a transparent layer molded on said first side and through which said graphics are viewable, wherein said ink pattern comprises a plurality of ink areas separated by gap regions therebetween, and wherein said substrate protrudes into said molded transparent layer, said molded transparent layer having differing depths comprising a first depth at said ink areas, and a second different depth at said gap regions, said molded transparent layer having a planar first side and an opposite nonplanar second side facing said substrate.

2. The emblem according to claim 1 wherein said substrate deforms around said ink pattern during molding of said molded transparent layer, to provide said differing depths.

3. The emblem according to claim 2 wherein said ink pattern is ultraviolet radiation hardened ink.

4. An emblem with encapsulated embossed 3-D graphics comprising a substrate having a first side and an opposite second side, an ink pattern printed on said second side and providing the embossed 3-D graphics, a transparent layer molded on said first side and through which said graphics are viewable, wherein:

said substrate comprises a transparent base layer and an ink layer printed thereon;

said ink pattern is printed on said ink layer and comprises a plurality of ink areas separated by gap regions therebetween;

said ink layer comprises portions in said gap regions;

said substrate protrudes into said molded transparent layer at said ink areas;

said molded transparent layer has differing depths comprising a first depth at said ink areas, and a second different depth at said gap regions.

5. The emblem according to claim 4 wherein said ink layer deforms around said ink pattern during molding of said molded transparent layer, to provide said differing depths.

6. The emblem according to claim 5 wherein said ink pattern is ultraviolet radiation hardened ink, and wherein the ink of said ink layer is other than ultraviolet radiation hardenable ink.

7. The emblem according to claim 4 wherein both said ink layer and said base layer deform around said ink pattern during molding of said molded transparent layer, to provide said differing depths.

8. An emblem with encapsulated embossed 3-D graphics comprising a substrate having a first side and an opposite second side, an ink pattern printed on said second side and providing the embossed 3-D graphics, a transparent layer molded on said first side and through which said graphics are viewable, wherein said substrate comprises a first substrate, and comprising a second substrate on the opposite side of said molded transparent layer from said first substrate, said second substrate having a first side and an opposite second side, said second side of said second substrate facing said first side of said first substrate across said molded transparent layer, and a second ink pattern printed on said second side of said second substrate.

9. The emblem according to claim 8 wherein said second ink pattern is nonembossed.

10. The emblem according to claim 8 wherein said second ink pattern is composed of ink directly contacted by said molded transparent layer during molding.

11. The emblem according to claim 8 wherein:

said second substrate is selected from the group consisting of clear, translucent and tinted materials;

said transparent molded layer is selected from the group consisting of clear, translucent and tinted materials; said first substrate comprises a transparent base layer selected from the group consisting of clear, translucent and tinted materials.

12. An emblem with embossed 3-D graphics, and a mold for producing said emblem, comprising in combination a substrate having a first side and an opposite second side, an ink pattern printed on said second side and providing the embossed 3-D graphics, a transparent layer molded on said first side and through which said graphics are viewable, said ink pattern comprising a plurality of ink areas separated by gap regions therebetween, wherein said substrate protrudes into said molded transparent layer, said molded transparent layer having differing depths comprising a first depth at said ink areas, and a second different depth at said gap regions, a mold for molding said molded transparent layer on said first side of said substrate, said mold having a smooth nonembossed surface engaging said second side of said substrate without a 3-D mold-insert.

13. The combination according to claim 12 wherein said substrate deforms around said ink pattern and against said smooth nonembossed surface of said mold during molding of said molded transparent layer, to provide said differing depths.

14. The combination according to claim 13 wherein said ink pattern is ultraviolet radiation hardened ink.

15. The combination according to claim 12 wherein:

said substrate comprises a transparent base layer and an ink layer printed thereon;

said ink pattern is printed on said ink layer and comprises a plurality of ink areas separated by gap regions therebetween;

said ink layer comprises portions in said gap regions;

said ink layer deforms around said ink pattern and against said smooth nonembossed surface of said mold during molding of said molded transparent layer, to provide said differing depths.

16. An emblem with embossed 3-D graphics, and a mold for producing said emblem, comprising in combination a substrate having a first side and an opposite second side, an ink pattern printed on said second side and providing the embossed 3-D graphics, a transparent layer molded on said first side and through which said graphics are viewable, said ink pattern comprising a plurality of ink areas separated by gap regions therebetween, wherein said substrate protrudes into said molded transparent layer, said molded transparent layer having differing depths comprising a first depth at said ink areas, and a second different depth at said gap regions, a mold for molding said molded transparent layer on said first side of said substrate, said mold having a smooth nonembossed surface engaging said second side of said substrate without a 3-D mold-insert, wherein:

said substrate comprises a transparent base layer having first and second ink layers printed thereon;

said ink pattern is printed on said second ink layer and comprises a plurality of ink areas separated by gap regions therebetween;

said first ink layer comprises portions in said gap regions;

said second ink layer comprises portions in said gap regions;

said second ink layer and said base layer deform around said ink pattern and against said smooth nonembossed surface of said mold during molding of said molded transparent layer, to provide said different depths.

17. An emblem with embossed 3-D graphics, and a mold for producing said emblem, comprising in combination a substrate having a first side and an opposite second side, an ink pattern printed on said second side and providing the embossed 3-D graphics, a transparent layer molded on said first side and through which said graphics are viewable, said ink pattern comprising a plurality of ink areas separated by gap regions therebetween, wherein said substrate protrudes into said molded transparent layer, said molded transparent layer having differing depths comprising a first depth at said ink areas, and a second different depth at said gap regions, a mold for molding said molded transparent layer on said first side of said substrate, said mold having a smooth nonembossed surface engaging said second side of said substrate without a 3-D mold-insert, and comprising a second substrate on the opposite side of said molded transparent layer from said first mentioned substrate, said second substrate having a first side and an opposite second side, said second side of said second substrate facing said first side of said first substrate across said molded transparent layer, and a second ink pattern printed on said second side of said second substrate.

* * * * *